US008313392B2

(12) United States Patent
White

(10) Patent No.: US 8,313,392 B2
(45) Date of Patent: Nov. 20, 2012

(54) CUSTOMIZABLE SPORTS IMPLEMENT SYSTEM AND METHOD

(76) Inventor: Mark White, Bloomington, IN (US)

( * ) Notice: Subject to any disclaimer, the term of this patent is extended or adjusted under 35 U.S.C. 154(b) by 134 days.

(21) Appl. No.: 12/855,979

(22) Filed: Aug. 13, 2010

(65) Prior Publication Data

US 2011/0077096 A1 Mar. 31, 2011

Related U.S. Application Data

(60) Provisional application No. 61/277,546, filed on Sep. 28, 2009, provisional application No. 61/340,187, filed on Mar. 15, 2010.

(51) Int. Cl.
*A63B 53/10* (2006.01)
*A63B 53/12* (2006.01)

(52) U.S. Cl. ..... 473/316; 473/296; 473/297; 473/409; 473/519; 294/81.3; 294/210; 482/109

(58) Field of Classification Search ..... 473/48, 473/316, 318, 322, 323, FOR. 168, FOR. 187, 473/44–49, 296, 288, 297; 294/81.1, 81.21, 294/81.3, 81.4, 209, 210; 482/109
See application file for complete search history.

(56) References Cited

U.S. PATENT DOCUMENTS

| | | | | |
|---|---|---|---|---|
| 2,107,983 | A * | 2/1938 | Hamilton | 473/296 |
| 2,475,927 | A | 7/1949 | Verderber | |
| 2,685,876 | A * | 8/1954 | Sanderson | 126/271.1 |
| 2,876,010 | A | 3/1959 | Hugman | |
| 3,524,646 | A | 8/1970 | Wheeler | |
| 4,461,479 | A | 7/1984 | Mitchell | |
| 4,600,195 | A | 7/1986 | Hunter | |
| 4,826,168 | A * | 5/1989 | McGuire et al. | 473/295 |
| 4,878,667 | A | 11/1989 | Tosti | |
| 4,949,964 | A * | 8/1990 | Jolly | 473/48 |
| 5,267,730 | A * | 12/1993 | Keaggy | 473/47 |
| 5,269,518 | A | 12/1993 | Kobayashi et al. | |
| 5,465,967 | A | 11/1995 | Boeckenhaupt | |
| 5,478,074 | A | 12/1995 | Storper | |
| 5,513,845 | A | 5/1996 | Sonagere | |
| 5,632,691 | A | 5/1997 | Hannon et al. | |
| 5,766,088 | A | 6/1998 | Severtsen | |
| 6,413,168 | B1 | 7/2002 | McKendry et al. | |
| 6,875,123 | B2 | 4/2005 | Wilson | |
| 6,988,958 | B2 | 1/2006 | Roelke | |
| 7,172,514 | B2 | 2/2007 | Benson | |
| 7,267,619 | B1 * | 9/2007 | Pettis | 473/297 |
| 7,481,716 | B1 | 1/2009 | Johnson | |
| 7,510,482 | B2 | 3/2009 | Benson | |
| 7,563,173 | B2 | 7/2009 | Chol | |
| 7,635,310 | B2 | 12/2009 | Keough | |

* cited by examiner

*Primary Examiner* — Gene Kim
*Assistant Examiner* — John E Simms, Jr.
(74) *Attorney, Agent, or Firm* — Liell & McNeil

(57) ABSTRACT

A customizable sports implement system includes a sports implement having an elongate primary shaft and an elongate grip shaft, and a customizing mechanism including length setting and weight components having a plurality of different assembly combinations, each of which may be installed within a cavity formed in one of the primary shaft and the grip shaft to set a playing length and playing weight of the sports implement. The sports implement system is adjustable among a plurality of different customized configurations by swapping different assembly combinations of the length setting and weight components into the cavity. A method of customizing a sports implement system includes adjusting the sports implement system among different customized configurations by swapping combinations of the length setting and weight components for one another within the cavity, and adjusting a length setting state of the length setting component. Each of the different customized configurations is associated with a different levering profile of the sports implement, which may include a golf club such as a putter.

20 Claims, 6 Drawing Sheets

CUSTOMIZABLE SPORTS IMPLEMENT SYSTEM AND METHOD

CROSS REFERENCE TO RELATED APPLICATIONS

This patent application claims the benefit of the filing dates of U.S. Provisional Patent Application Ser. No. 61/277,546, filed Sep. 28, 2009, and U.S. Provisional Patent Application Ser. No. 61/340,187, filed Mar. 15, 2010.

TECHNICAL FIELD

The present disclosure relates generally to customizable sports implement systems, and relates more particularly to customizing playing length and playing weight of a sports implement by way of components positionable within a shaft cavity in a plurality of different assembly combinations.

BACKGROUND

A wide variety of different sporting activities utilize a sports implement to enable a player to manipulate a playing article such as a ball. Tennis, golf, baseball, hockey, polo and billiards are all familiar examples. For beginners in any of these and other such sporting activities, the design and mechanical properties of a sports implement will typically have less influence on a player's success than inherent athletic abilities and work ethic. As players progress, however, the importance of equipment technology tends to increase in a manner that will be familiar to most. Golf is one sporting activity where player advancement often begins to plateau in the absence of improved and customized equipment, and advanced instruction.

Golf is a complex and demanding sport. There are many elements of play, but the most complex, demanding and perhaps most important element, is putting. The expectation of par golf is that half the strokes in a round are allocated to putts. In the world of sport, an apt place to apply the label of "sweet science" is the practice of putting a golf ball into a hole. Putting involves four components: a golfer, a ball, a green, and a putter. The green and the golfer are living things and therefore subject to imperfections and changes over time. The ball and putter are inanimate objects fixed by rules of the game. The challenge of putting pits the golfer against the green, and the margin of error may be breathtakingly small in terms of forces, angles and consistency and repeatability of player performance. It is imperative then, at least for serious players, that the putter be optimally suited to the golfer.

A putter is a simple machine called a lever. The putter, however, is not a simple lever, at least in the way it is employed by a golfer to strike a golf ball. By itself a putter is a class 1 lever. Application of a golfer to a putter, however, converts the putter into elements of both a class 2 and a class 3 lever. The golfer and putter may be understood as a single, complex lever, and multiple fulcrums and force applications need to be considered to understand the physics of the act of putting. While knowledge of physics is not necessary for able putting, it is a core element of putter engineering.

Those skilled in the art will be familiar with "changes" to a golfer, and even the greens, some virtually imperceptible, from day to day. The golfer may sleep wrong, eat too much breakfast, or have a flare-up of arthritis, for instance. Ask any golfer about his or her poorer than expected performance, and one may receive a credible, but often bizarre explanation rooted more in psychology or philosophy than science. With regard to the greens, they may be wet from dew, closely mowed, or vary in some other seemingly trivial manner such as having a different hue from different light conditions, in contrast to their condition on a previous day. It is well established that these and other seemingly subtle factors can affect the ability of a golfer to successfully putt a golf ball into the hole.

In the field of golf and other sporting activities of the type contemplated herein, athletes, equipment designers, coaches and others have proposed a great many different strategies over the years for customizing sports equipment to a player. It is believed, and at least mostly correctly, that fit, feel, and mechanical properties of a sports implement can allow players to adapt to varying conditions, or so develop their own performance that they become somewhat immunized from subtle, day to day variations. In other words, customized equipment is typically used to either enable a player to "solve" specific game problems, or to more generally influence and stabilize the way a player performs. One example of the former might be a specialized cue stick used by a billiards player for jump shots. An example of the latter might be a cue stick that is sized, weighted, contoured, or even colored to best suit the billiards player in general. Still another example might be a cue stick that can be changed in weight at the whim of the player.

Returning to the case of golf, it is believed by many that relatively minute adjustments in equipment can enable a golfer to optimally calibrate his or her performance. A golfer who is feeling different, psychologically or physically, than he or she did on a previous day, may attempt to adjust his golf clubs to improve his or her ability to successfully putt a ball into the hole. Trainers or golfers themselves also may attempt to customize equipment during practice sessions based on intuition and observations. For either case, known customizing systems have drawbacks.

Many conventional golf club designs focus on a parameter generally referred to as "swing weight." Swing weight defines the balance point of the club, or the fulcrum around which the club balances horizontally without any external force applied. A change in the length, weight or distribution of weight in any component of a golf club such as a putter, or many other sports implements for that matter, can change the total weight and the swing weight, altering the function. One conventional customizing approach is to offer players a wide variety of different clubs, each purpose-built to have a different swing weight, and then allow a player to use the different clubs and determine which they prefer. The downsides to maintaining or obtaining such a broad club inventory are readily apparent. Other customizing techniques have attempted to provide individual clubs which may be adjusted to vary swing weight. These too have drawbacks, notably complexity, expense, and the undue amount of time typically required to make adjustments. Moreover, while such adjustments may be helpful, swing weight is not the whole story when it comes to customizing golf clubs, and is often overemphasized. Interchangeable grips, interchangeable club heads, and other customizable features are also known. It is really a player's deeply subjective impression of the "feel" of a sports implement, however, irrespective of actual mechanical properties, which likely determines how successful a player will be. Achieving a superior, or even simply satisfactory, subjective feel of a golf club is a difficult goal to achieve, particularly in view of the sort of day to day changes a golfer may experience, as noted above. In sum, previous attempts at customizable sports implements, and in particular adjustable golf clubs, have largely focused unduly on adjusting certain individual parameters, or failed to integrate adjustability of multiple different parameters into a simple, user friendly system that can be tailored to a golfer's present preferences or innate tendencies.

SUMMARY OF THE DISCLOSURE

In one aspect, a method of customizing a sports implement system having an elongate primary shaft, an elongate grip shaft, and a customizing mechanism having a length setting component including a plurality of different length setting states, a plurality of weight components, and a coupling component for locking the grip shaft coaxially to the primary shaft is provided. The method includes placing the sports implement system in a first configuration at which a first combination of the length setting and weight components are installed within a cavity defined by at least one of the primary shaft and the grip shaft. The method further includes adjusting the sports implement system to a second configuration via swapping a second combination of the length setting and weight components for the first combination installed within the cavity. The method further includes adjusting the sports implement system to a third configuration via removing whichever of the first or second combination is installed within the cavity, changing the length setting state of the length setting component, and re-installing the corresponding combination within the cavity. Each of the adjusting steps further includes setting a combination of playing weight and playing length of the sports implement system at least in part by contacting each of the grip shaft and the primary shaft with the installed combination of length setting and weight components within the cavity, and locking the coupling component. Each of the first, second, and third configurations includes a different combination of playing weight and playing length, and the method further includes customizing the playing weight and playing length via the adjusting steps, responsive to using the sports implement system in each of the first, second, and third configurations.

In another aspect, a sports implement system includes a sports implement having an elongate primary shaft with a proximal shaft end and a distal shaft end, and an elongate grip shaft with a proximal grip end and a distal grip end. At least one of the primary shaft and the grip shaft includes a cavity formed therein defining a longitudinal cavity axis extending between an open cavity end and a blind cavity end. The sports implement system further includes a customizing mechanism having a coupling component with a locking state for connecting the primary shaft coaxially with the grip shaft, and a release state. The customizing mechanism further includes at least one length setting component and a plurality of weight components, the length setting and weight components having among them a plurality of different assembly combinations. Each of the assembly combinations includes an equal number of weight components, a different weight and an adjustable length. The plurality of different assembly combinations further includes a first assembly combination installed within the cavity and contacting each of the grip shaft and the primary shaft. The coupling component is in the locking state setting the sports implement system in a first configuration having a first playing weight and a first playing length based on a weight and length of the first assembly combination. The plurality of different assembly combinations further includes a second assembly combination, and the sports implement system is adjustable to a second configuration which includes a second playing weight and a second playing length based on a weight and length of the second assembly combination, at least in part by swapping the second assembly combination into the cavity in place of the first assembly combination.

In still another aspect, a method of adjusting a customizable levering profile of a sports implement having an elongate primary shaft, an elongate grip shaft, and a coupling component for locking the grip shaft coaxially to the primary shaft, is provided. The method includes decoupling the primary shaft from the grip shaft at least in part by unlocking the coupling component, and sliding one of the primary shaft and the grip shaft out of a cavity formed in the other of the primary shaft and the grip shaft. The method further includes setting a playing weight of the sports implement system at an adjusted playing weight at least in part by swapping a first assembly combination of length setting and weight components for a second assembly combination of length setting and weight components installed within the cavity, the first and second assembly combinations each including an equal number of weight components. The method further includes setting a playing length of the sports implement system at an adjusted playing length at least in part by adjusting a length setting state of a length setting component of the first assembly combination, prior to installing the first assembly combination within the cavity. The method still further includes placing the sports implement in a configuration having an adjusted levering profile defined by the adjusted playing length and the adjusted playing weight at least in part by sliding the one of the primary shaft and the grip shaft back into the cavity, stopping the one of the primary shaft and the grip shaft at a stop location contacting the first assembly combination, and re-locking the coupling component.

DETAILED DESCRIPTION

Figure 1:
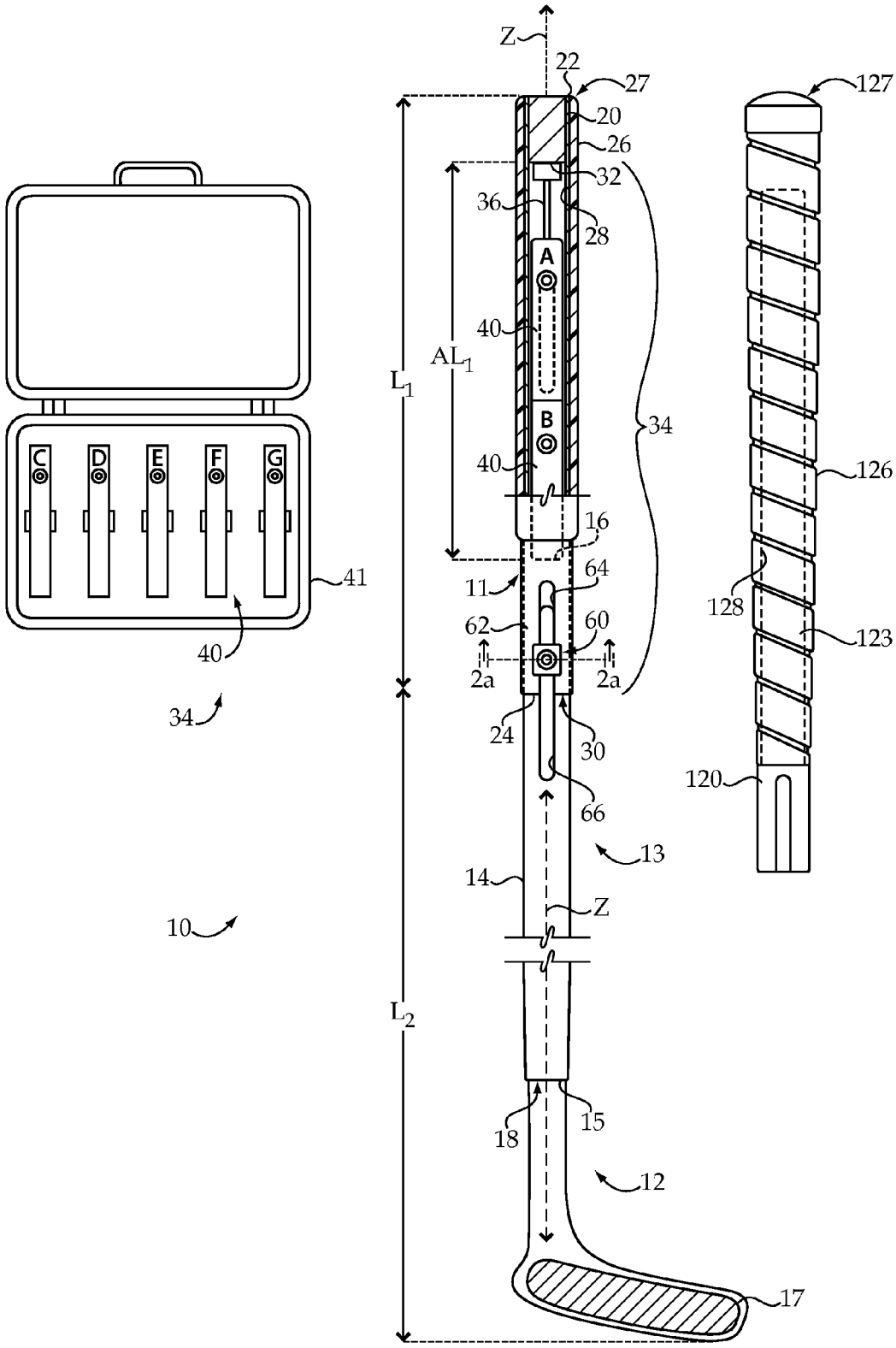
FIG. 1 is a partially sectioned system level diagram of a customizable sports implement system, according to one embodiment.

Referring to FIG. 1, there is shown a customizable sports implement system 10 according to one embodiment. Sports implement 10 is shown in the context of a golf club system, and in particular a putter. The teachings set forth herein, however, are expected to be broadly applicable to sports implement systems where a player applies a swing or other levering action to a shaft to transfer force to a playing article such as a ball. Based on the unique design configurations and selection of components for sports implement systems according to the present disclosure, a player or professional trainer can customize a sports implement in a wide variety of different ways to tailor force transfer characteristics, player perceptions, and other properties in response to the desires or tendencies of the player or the intended mechanical behavior of the sports implement. These properties of sports implement systems according to the present disclosure may be varied in a facile and rapid manner not possible, or at least not practicable, in known strategies, as further described herein.

System 10 may include a sports implement 12, such as a putter having a shaft assembly 13 and a head 17 connected with shaft assembly 13 at a coupling 15. In the embodiment shown, head 17 is a component separate from shaft assembly 13, enabling different heads to be swapped for one another and alternately connected with shaft assembly 13. In other embodiments, head 17 might be irreversibly connected with other components of shaft assembly 13. Implement 12 may further include a first elongate shaft 14 which includes a primary shaft having a proximal shaft end 16 and a distal shaft end 18. Implement 12 may further include a second elongate shaft 20 which includes a grip shaft having a proximal grip end 22 and a distal grip end 24. At least one of primary shaft 14 and grip shaft 20 may include a cavity 28 formed therein, and having an open cavity end 30 and a blind cavity end 32. In the embodiment shown, cavity 28 is formed in grip shaft 20, but could alternatively be formed in primary shaft 14, or formed in part in each of primary shaft 14 and grip shaft 20. System 10 may also include a customizing mechanism 34.

Customizing mechanism 34 may include a coupling component 60 having a locking state and a release state, and being configured to connect grip shaft 20 coaxially to primary shaft 14. A longitudinal axis Z is shown in FIG. 1, representing a common longitudinal axis of each of primary shaft 14 and grip shaft 20 when connected. Customizing mechanism 34 may further include at least one length setting component 36, and a plurality of weight components 40. In FIG. 1, a first assembly combination of component 36 and components 40 are positioned within cavity 28, and set a playing weight and playing length of system 10 by way of principles further described herein.

Grip shaft 20 may be part of a first grip and shaft assembly 27 which includes shaft 20, and a grip 26 such as a conventional rubberized or other type of hand grip, positioned on shaft 20 in a conventional manner. System 10 may also include a second grip and shaft assembly 127 which includes a grip shaft 120 having a grip 126 positioned thereon. Grip and shaft assembly 127 may be connected coaxially with primary shaft 14 in place of grip and shaft assembly 27, via coupling component 60, for instance. Grip 26 may include a first hand grip geometry, which in the illustrated embodiment includes a plain, generally cylindrical outer surface geometry. An outer grip surface 123 of grip 126 may include a second hand grip geometry, which is different from the first hand grip geometry. In the illustrated embodiment, the hand grip geometry of grip and shaft assembly 127 may include a non-uniform, undular geometry such as that attained by wrapping a rubberized or other type of strip material about grip shaft 120 and securing it thereto. A wide variety of other hand grip geometries might be used for either of grip and shaft assembly 27 or grip and shaft assembly 127. Moreover, embodiments are contemplated in which system 10 includes a number of grip and shaft assemblies greater than two, each of which includes a different hand grip geometry. Grip and shaft assembly 127 may further include a cavity 128 defined by shaft 120, which enables components of customizing mechanism 34 to be installed within cavity 128 when grip and shaft assembly 127 is coupled with primary shaft 14, in a manner analogous to that of grip and shaft assembly 27. Cavity 128 may include a cavity shape and dimensions identical to a shape of cavity 28.

Also shown in FIG. 1 are additional components of customizing mechanism 34, in particular a plurality of additional weight components 40 positioned in a case 41. As further described herein, one or more of weight components 40 carried in case 41 may be swapped for weight components 40 currently installed within cavity 28 to adjust and customize system 10.

Figure 3:
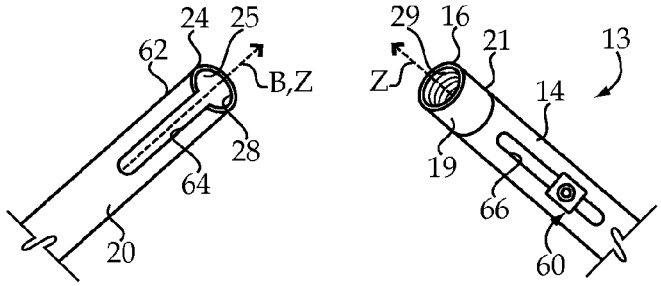
FIG. 3 is a disassembled diagrammatic view of a portion of the system of FIG. 1.

Turning to FIG. 3, there is shown a disassembled view of shaft assembly 13. Visible in FIG. 3 is an inner surface 25 of grip shaft 20 which defines cavity 28. A longitudinal cavity axis B is collinear with longitudinal axis Z. In one embodiment, inner surface 25 may include a cylindrical surface extending between proximal grip end 22 and distal grip end 24. Inner surface 25 may further include a partially cylindrical distal portion, which includes an inner surface of a skirt 62 located on and including distal grip end 24. Skirt 62 defines an axially extending open ended channel 64 in communication with cavity 28. Also shown in FIG. 3 is a portion of primary shaft 14, including proximal shaft end 16, which may be located on a base or end cap 19 which includes an outer surface 21. Inner surface 25 may include an inner surface shape as noted above, and outer surface 21 of end cap 19 may include an outer surface shape which is complementary to the inner surface shape. In the illustrated embodiment, surfaces 25 and 21 are generally cylindrical, however, in other embodiments a different surface shape such as a polygonal shape might be used to facilitate mating engagement between the respective components. Proximal shaft end 16 may further include a plurality of internal threads 29 formed therein, for connecting with weight components 40 as further described herein. It may also be noted from FIG. 3 that an axially extending closed ended channel 66 is formed in primary shaft 14. Each of skirt 62, and base 19, as well as open ended channel 64 and closed ended channel 66, may be considered part of coupling component 60.

Figure 2A:
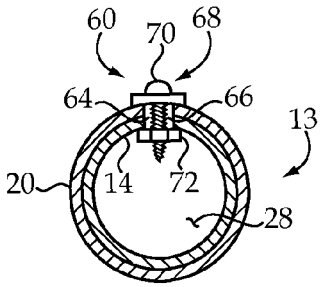
FIG. 2*a* is a sectioned view taken along line 2*a*-2*a* of FIG. 1.

Turning also now to FIG. 2*a*, there is shown a sectioned view taken along line 2*a*-2*a* of FIG. 1, and illustrating certain features of shaft assembly 13 and coupling component 60 in more detail. At the state illustrated in FIG. 2*a*, primary shaft 14 has been slid into cavity 28 such that shaft 14 and grip shaft 20 are coaxially arranged, and open ended channel 64 and closed ended channel 66 align and are in communication with one another. Coupling component 60 may further include a fastening assembly 68 which is captive within closed ended channel 66, but slidable axially therein through a continuum of locations to enable grip shaft 20 and primary shaft 14 to be locked together at a range of different relative axial positions, corresponding to a range of different playing lengths of sports implement 12. Fastening mechanism 68 may include a fastener 70 which extends in a radial direction through each of channel 64 and 66 into cavity 28. A nut 72 may be threadedly engaged with fastener 70. To lock coupling component 60, fastener 70 may be rotated in a first direction to engage with nut 72 and squeeze shafts 14 and 20 together, locking shafts 14 and 20 against sliding relative to one another. As further described herein, a relative position of shafts 14 and 20 may be defined by a length of an assembly combination installed in cavity 28. Fastener 70 may be rotated in an opposite direction to unlock coupling component 60, loosening nut 72 and allowing shafts 14 and 20 to slide relative to one another for decoupling.

Figure 2B:
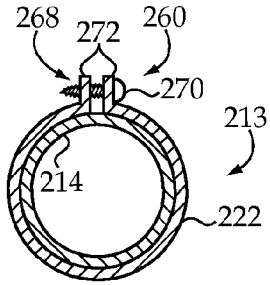
FIG. 2*b* is a sectioned view similar to FIG. 2*a*, according to another embodiment.

Referring to FIG. 2*b*, there is shown a shaft assembly 213 according to another embodiment, having a coupling component 260 with an alternative configuration. In particular, coupling component 260 may include a rotatable fastener 270 which extends through a set of flanges 272 connected to an outer shaft 222 such as a grip shaft or primary shaft as described herein. Flanges 272 and fastener 270 may be part of a fastening assembly 268. One of flanges 272 might be internally threaded, or a nut provided to enable assembly 268 to perform functions similar to those described in connection with fastening assembly 68. Those skilled in the art will appreciate that a wide variety of different strategies for locking two coaxial shafts together might be used within the context of the present disclosure. For instance, an outer shaft of a coaxial shaft assembly might include one or more set screws which enable it to lock at a plurality of different axial locations to an inner shaft. In further embodiments, a friction locking mechanism such as the type used in connection with certain telescoping hand tools might be used. Spring buttons, pins, and still other strategies might also be used. It will thus be readily understood that the present disclosure contemplates coaxial shafts in sports implement systems without limitation to any particular hardware or functional configuration apart from having a locking state and a release state to allow the shafts to be locked together at a range of axial locations, adjusted, and decoupled from one another altogether.

Figure 5:
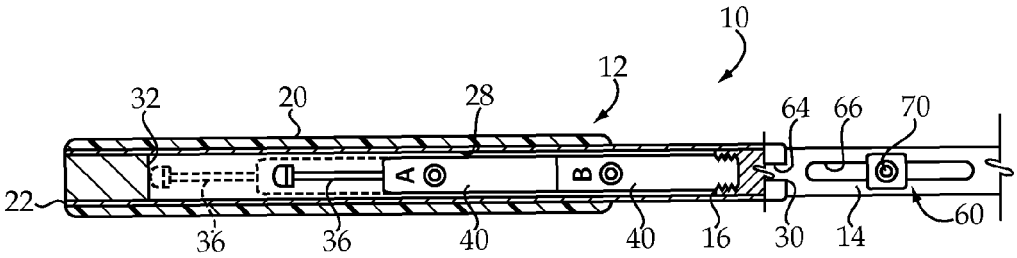
FIG. 5 is a partially sectioned side diagrammatic view of a portion of the sports implement system shown in FIG. 1.

Referring to FIG. 5, there is shown a portion of sports implement system 10 as it might appear when shafts 14 and 20 are being slid into or out of engagement with one another, such as for adjusting a playing weight and/or playing length of system 10 as further described herein. As discussed above, coupling component 60 may be used to lock shafts 14 and 20 together at a desired relative axial location, corresponding to a playing length of sports implement 12. During engaging shaft 14 with shaft 20, proximal end 16 of shaft 14 may be slid into cavity 28. An assembly combination of length setting component 36 and weight components 40 may be connected with proximal shaft end 16 and also slid into cavity 28. During sliding primary shaft 14 into grip shaft 20, channels 64 and 66 may be aligned and fastening assembly 68 may be slid into channel 64. In one embodiment, shaft 14 may be slid into shaft 20 to a stop location at which length setting component 36 contacts blind cavity end 32. In FIG. 5, portions of the assembly combination of length setting component 36 and weight components 40 are shown in phantom approximately as they might appear at the stop location. Once the stop location is reached, fastener 70 may be rotated to lock coupling component 60 and fix shafts 14 and 20 at the stop location. Decoupling shaft 14 from shaft 20 can occur by way of a generally reverse process, rotating fastener 70 in an opposite direction, and sliding shaft 14 out of cavity 28.

Figure 4:
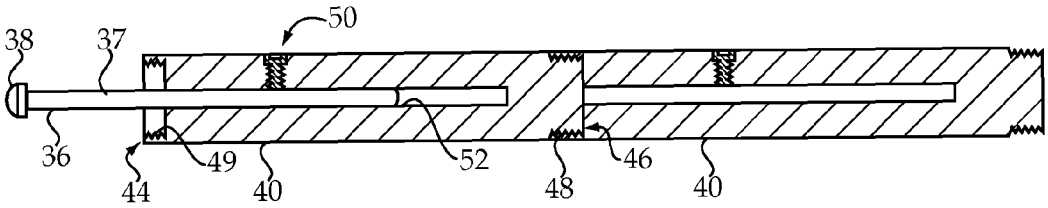
FIG. 4 is a partially sectioned side diagrammatic view through an assembly combination of length setting and weight components, according to one embodiment.

Length setting component 36 may be connected with one of weight components 40 prior to installing a given assembly combination within cavity 28. Referring to FIG. 4, there is shown a view of length setting component 36 and two weight components 40 coupled together as they might appear in preparation for installing in cavity 28. In the embodiment shown, length setting component 36 includes a shaft 37 and a head 38, which is configured to contact blind cavity end 32 as described above. It will be recalled that cavity 28 includes a shape such as a generally cylindrical shape. Weight components 40 may include a geometric footprint which is accordant with a shape of cavity 28. As used herein, the term "accordant" means that the geometric footprint of weight components 40, such as the axial geometric footprint evident when observing weight components 40 from an axial end thereof, is sized and shaped to enable insertion into cavity 28. In the illustrated embodiment, the axial geometric footprint of each of weight components 40 may include a circular footprint, having dimensions slightly smaller than corresponding dimensions of cavity 28, and each of weight components 40 may be generally cylindrical. Each of weight components 40 of the assembly combination depicted in FIG. 4 may also be connected together. To this end, each of weight components 40 may include a set of external threads 48 which are configured to engage with a set of internal threads 49 of an adjoining weight component, or engage with threads 29 of primary shaft 14. Also shown in FIG. 4 is a fixturing mechanism 50 of each weight component 40 which may be used to connect with length setting component 36. In one embodiment, fixturing mechanism 50 may include a set screw which is rotatable within the corresponding weight component to engage with shaft 37 of length setting component 36. By loosening fixturing mechanism 50, length setting component 36 may be adjusted to any of a plurality of different insertion depths within a bore 52 formed in the corresponding weight component 40, or removed and placed at a desired insertion depth in a different weight component 40. It may thus be appreciated that varying an insertion depth of length setting component 36, which may include a length setting pin as shown, within a bore 52 in one of weight components 40 can allow an axial distance separating blind cavity end 32 and proximal shaft end 16 within cavity 28 to be varied, in turn varying a playing length of sports implement 12. Coupling shafts 14 and 20 together in the manner described above can also set a playing weight of sports implement system 10. As further described herein, the playing weight may be an adjustable playing weight which is based on the selected weight components 40 which are installed within cavity 28.

Figure 6:
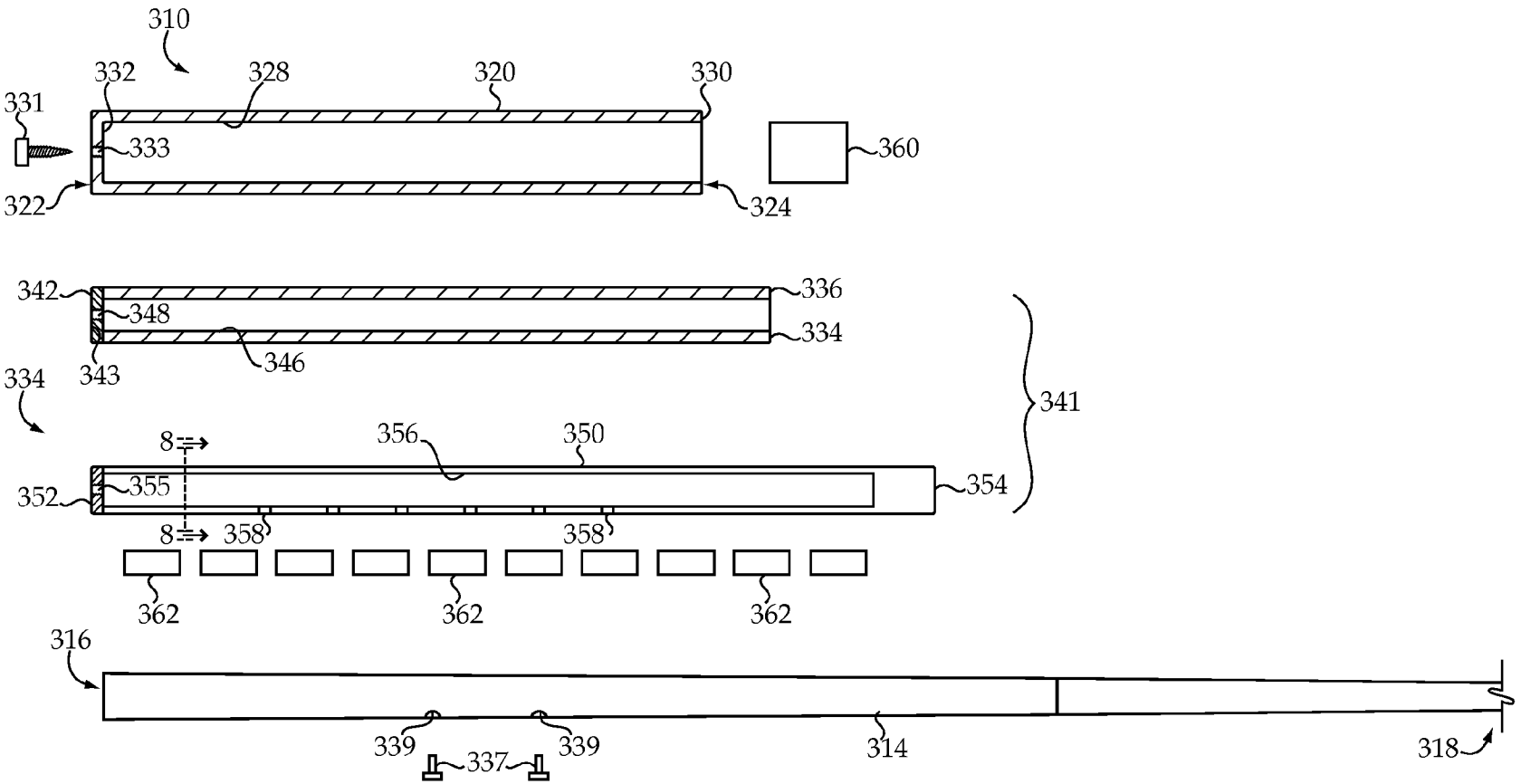
FIG. 6 is a partially sectioned system level diagram of a customizable sports implement system, according to another embodiment.

Referring now to FIG. 6, there is shown a system level diagram of a sports implement system 310 according to another embodiment. System 310 includes certain similarities with system 10 described above, but also certain differences. In particular, system 310 is similarly configured for relatively rapid and simple adjustment of playing weight and playing length, and may be used with any of a wide variety of sports implement systems such as golf clubs. The manner in which weights and length setting components and the like are carried within system 310, and adjusted, is different from certain of the embodiments described above. System 310 may include a primary shaft 314 having a proximal shaft end 316, and a distal shaft end 318. System 310 may also include a grip shaft 320 having a proximal grip end 322, and a distal grip end 324, and defining a cavity 328 having an open cavity end 330 and a blind cavity end 332. A bore 333 may be formed in blind cavity end 332 and configured to receive a threaded fastener 331 for purposes described below.

System 310 may also include a customizing mechanism 334 having a length setting component 341 and a plurality of weight components 362. Length setting component 341 may include a first shaft 336 having a proximal end 342, and a distal end 344, and defining another cavity 346. A cap plate 343 having a threaded bore 348 formed therein may be positioned at proximal end 342. Shaft 336 may be installed within cavity 328, and fastener 331 passed through bores 333 and 348 to threadedly secure shaft 336 and components carried therein within cavity 328. Length setting component 341 may also include a carrier component 350 which includes a partially cylindrical component having a trough 356 or the like formed therein, and extending between a proximal carrier end 352 and a distal carrier end 354. A cap plate 353 having a threaded bore 355 formed therein may be positioned at proximal end 352. Carrier component 350 may be positionable within cavity 346 such that cap plate 353 abuts cap plate 343 of shaft 336, and positions bore 355 to be threadedly engaged with fastener 331. Carrier component 350 may further include a plurality of apertures 358 formed therein. A set of one or more pins 337 may be passed through additional apertures 339 formed in primary shaft 314, and thenceforth into apertures 358. It may be noted that a plurality of apertures 358 are spaced along carrier component 350, allowing pins 337 to be engaged with different axially positioned apertures 358 to provide a range of different axial positions of carrier component 350 within primary shaft 314. All, some, or none, of weight components 362 may be positioned within trough 356 to allow a playing weight of sports implement system 310 to be varied.

Figure 7:
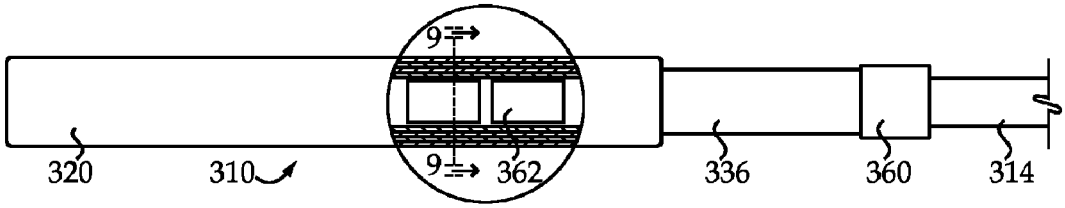
FIG. 7 is a partially sectioned side diagrammatic view of a portion of the system of FIG. 6.
Figure 8:
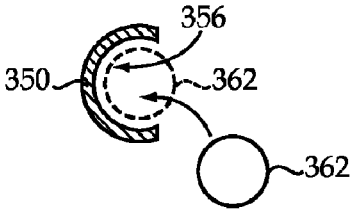
FIG. 8 is a sectioned view taken along line 8-8 of FIG. 6.
Figure 9:
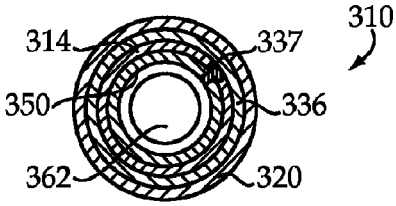
FIG. 9 is a sectioned view taken along line 9-9 of FIG. 7.

Referring to FIG. 7, there is shown sports implement system 310 in an assembled configuration, and including a partial sectioned view showing components positioned within grip shaft 320. Referring also to FIG. 9, there is shown a sectioned view taken along line 9-9 of FIG. 7. It may be noted that each of shaft 320, shaft 336, carrier component 350, and shaft 314 are coaxially arranged. A plurality of weight components 362 are positioned within carrier component 350. It may also be noted from FIG. 9 that a weight component 362 is at a radially innermost location in the assembled state of system 310. Moving in a radially outward direction, carrier component 350 is the next component, followed by primary shaft 314, then shaft 336, and finally grip shaft 320. It will thus be appreciated that by varying which of apertures 358 are selected for positioning of pins 337, a relative axial position of carrier component 350 within primary shaft 314 may be varied. By selecting a number of weight components 362 to position within trough 356, a weight of system 310 may also be varied, in turn varying playing length of an associated sports implement. FIG. 8 illustrates a sectioned view taken along line 8-8 of FIG. 6, illustrating an example positioning of a weight components 362 within trough 356.

Figure 10:
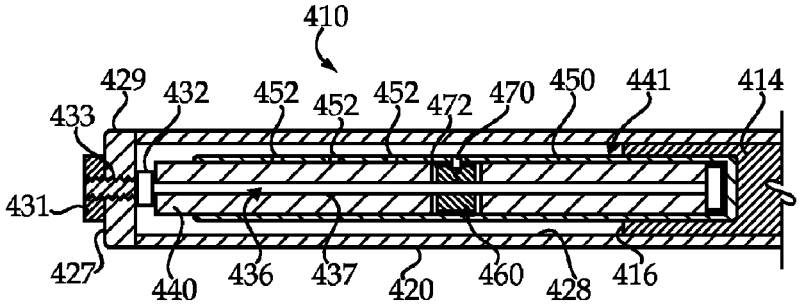
FIG. 10 is a partially sectioned side diagrammatic view of a portion of a customizable sports implement system, according another embodiment.

Referring now to FIG. 10, there is shown a sports implement system 410 according to yet another embodiment. System 410 also includes certain similarities with the foregoing embodiments, but also certain differences. In system 410, a grip shaft 420 is provided which includes a proximal grip end 427, and a distal grip end which is not visible in FIG. 10. A cap plate 429 may be positioned at proximal grip end 427. A length setting component 436, and a plurality of weight components 440 may be positioned within a carrier 450 received within a cavity 428 defined by grip shaft 420. Weight components 440 and length setting component 436 may be coupled with a proximal end 416 of a primary shaft 414. Carrier component 450 might be formed integrally with primary shaft 414, connected with shaft 414 via threads, or attached by any other suitable mechanism.

Length setting component 436 may include a spindle 437 which includes a coupling component 460 mounted thereon. Coupling component 460 may include a base 472 and a spring loaded button 470 which is positionable within any of a plurality of different axially spaced apertures 452 formed in carrier 450. It may thus be appreciated that by varying which aperture 452 receives button 470, a distance between proximal shaft end 416 and cap plate 429, which is abutted by a head 432 connected with spindle 437, may be varied. Head 432 may further include a fastener 433 which projects through cap plate 429 and may be threadedly engaged with a nut 431 positioned external to grip shaft 420. In one embodiment, connector 433 may include a polygonal configuration such as a hex configuration having a finite number of different alignment orientations within cap plate 429. Since connector 433 may in such an embodiment only be positioned within cap plate 429 in a finite number of different orientations, such as a single orientation, proper alignment of grip shaft 420 relative to primary shaft 414 during assembly, may be established. By loosening nut 431, the components positioned internally within cavity 428 may be removed, and the number or type of weight components 440 changed, to adjust a playing weight of sports implement system 410. Similarly, spring button 470 may be adjusted to vary a playing length of sports implement 410.

Returning to FIG. 1, it will be recalled that customizing mechanism 34 may include a system of different components which may be coupled together in any of a plurality of different assembly combinations. Each of the different assembly combinations includes at least one weight component 40, and length setting component 36, or a different length setting component. In FIG. 1, weight components 40 include a total number of weight components equal to seven. At any given time, a total of two weight components 40 may be installed in an assembly combination within cavity 28, and the remaining weight components may be stored in case 41 for instance. Weight components 40 are identified with reference letters A, B, C, D, E, F, G in FIG. 1. Hereinafter, discussion of uses or properties generic to all of weight components 40 refer to the weight components generically via reference numeral 40; references to specific ones of weight components 40 use the appropriate reference letter, whereas references to assembly combinations of multiple weight components use both applicable reference letters and numeral 40.

Each of weight components 40 may include an identical geometric footprint, including both shape and size, although the present disclosure is not thereby limited. Weight components 40 may also include among them a plurality of different weights. It will thus be understood that by combining different weight components 40 in different assembly combinations with one another and with length setting component 36, a range of numerous different total weights of the assembly combinations may be obtained. In certain instances, a single one of weight components 40 might be installed within cavity 28 at any given time, and used to set a playing weight of system 10. However, the use of two weight components installed within cavity 28, and then swapping one or more of them with other weight components 40 installed within cavity 28, provides a highly flexible practical implementation strategy.

In one embodiment, each of weight components A and B may include an equal weight. Although each of weight components A and B will of course include some actual weight, for illustrative purposes they may be assumed to have a weight equal to zero. Accordingly, sports implement system 10, and in particular sports implement 12, may be understood to be in a configuration in FIG. 1 which has a minimum playing weight. The weight components 40 not installed in cavity 28, and shown in case 41 in FIG. 1, may each include a different unique weight. For instance, weight component C may include a weight equal to 10 grams, weight component D may include a weight equal to twenty grams, weight component E may include a weight equal to thirty grams, weight component F may include a weight equal to forty grams, and weight component G may include a weight equal to eighty grams. By installing two of weight components 40 at a time within cavity 28, sports implement 12 may be configured with a playing weight anywhere from a baseline or minimum weight and a playing weight of the baseline plus 120 grams in 10 gram increments. Other embodiments might use different weight increments, such as five gram increments, and/or different numbers of weight components than that shown and described herein.

It will be recalled that length setting component 36 may be positioned at any of a range of insertion depths within any one of weight components 40. In the configuration shown in FIG. 1, length setting component 36 is positioned at an insertion depth within weight component A which defines an assembly combination length $AL_1$. Length $AL_1$ in turn defines a playing length of sports implement 12, as length $AL_1$ can determine a relative axial position of primary shaft 14 and grip shaft 20. Another length dimension $L_1$ is shown in FIG. 1 and represents an adjustable length dimension of sports implement 12, defined by the corresponding assembly combination length. Yet another length dimension $L_2$ includes a fixed length dimension. A playing length of sports implement 12 thus includes the sum of adjustable length $L_1$ and fixed length $L_2$.

In FIG. 1 sports implement system 10 may be understood to be in a first configuration, at which a first assembly combination 40AB comprised of length setting component 36, and each of weight components A and B is installed within cavity 28 and contacts each of grip shaft 20 and primary shaft 14. In particular, the installed assembly combination contacts blind cavity end 32, and contacts proximal shaft end 16. Coupling component 60 is in the locking state in FIG. 1, setting sports implement system 10 in the first configuration, at which it includes a first playing weight and a first playing length based on a weight and length of the installed assembly combination 40AB. It will also be recalled that components of customizing mechanism 34 may include additional assembly combinations which are not installed in cavity 28, but which may be swapped for the installed assembly combination. The one or more additional assembly combinations may be swapped for the installed assembly combination to impart different configurations to system 10, each of which imparts a different playing weight. By adjusting length setting component 36 to a different insertion depth within the weight component of an assembly combination to be installed in cavity 28, different playing lengths of sports implement system 10 may be set.

Figure 11:
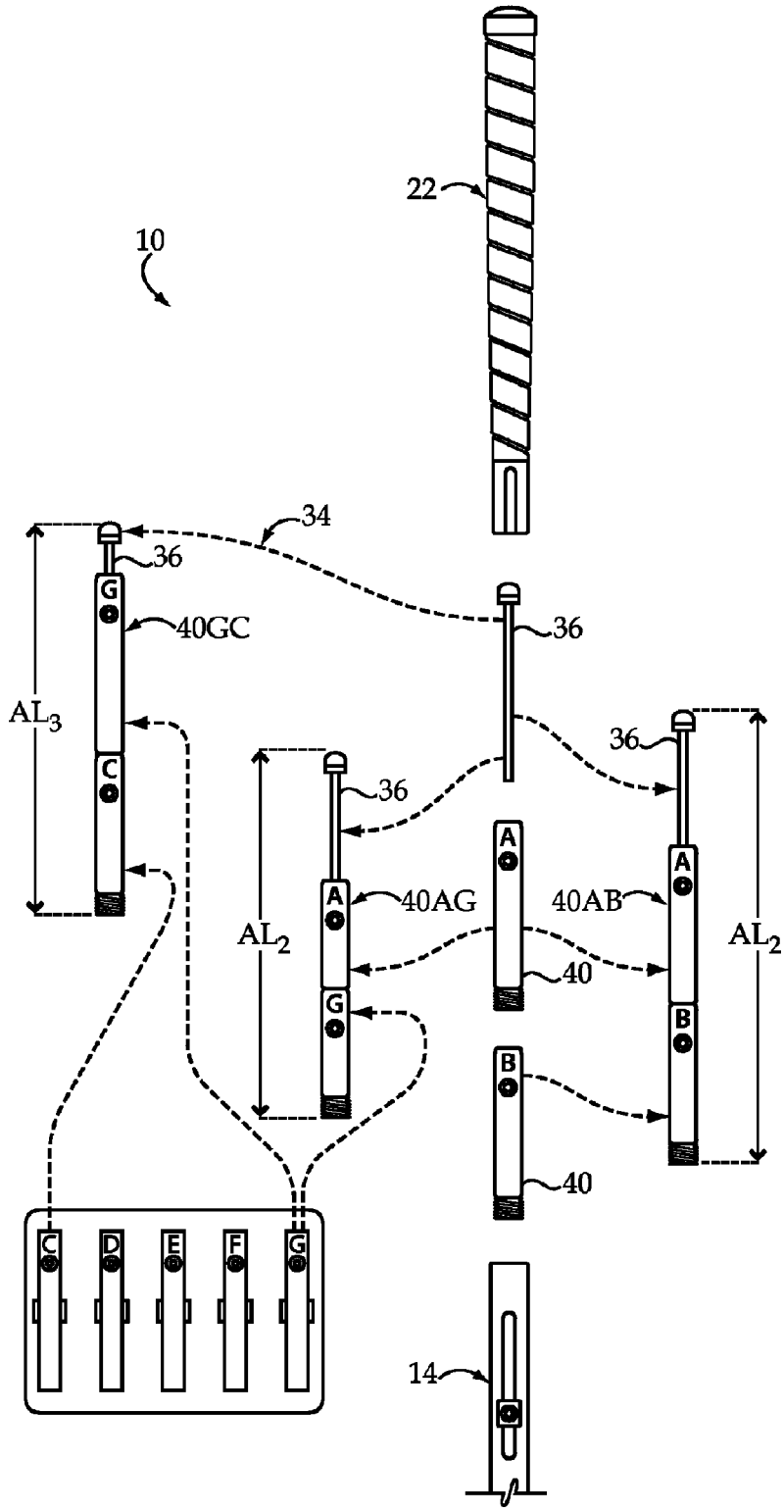
FIG. 11 is a pictorial view of a portion of the sports implement system of FIG. 1, illustrating length setting and spacing components in a plurality of different assembly combinations.

Referring now also to FIG. 11, there is shown a view of a plurality of different assembly combinations of weight components 40, and length setting component 36, each of which may be installed within cavity 28 to place sports implement system 10 in a different configuration. A first assembly combination 40AB, which is the same assembly combination installed within cavity 28 in FIG. 1, is shown in FIG. 11. In FIG. 11, however, an insertion depth of length setting component 36 has been adjusted such that combination 40AB includes an assembly combination length $AL_2$ different from length $AL_1$. Also shown in FIG. 11 is a second assembly combination 40AG which defines the same or a similar assembly combination length $AL_2$, but which will be understood to include a different assembly combination weight since weight component G has been substituted for weight component B. Yet another assembly combination 40GC is shown in FIG. 11, which includes yet another weight, since weight component C has been substituted for weight component A. Assembly combination 40GC also includes a different assembly combination length $AL_3$ since length setting component 36 has been adjusted to a different insertion depth within weight component G compared with its insertion depth in assembly combination 40AG. As further described herein, each of the different assembly combinations shown in FIG. 11 may be installed within cavity 28 to place sports implement system 10 in a configuration having a unique playing weight, and by setting or adjusting length setting component 36 a unique playing length. It will further be appreciated that only several of the possible assembly combinations are shown in FIG. 11, and the other weight components D, E, F, might be substituted for or coupled with any of the other weight components of system to create still other assembly combinations. Further, length setting component 36 may be positioned at any of an essentially infinite range of insertion depths within any one of weight components 40, to impart an essentially infinite range of playing lengths to sports implement system 10.

INDUSTRIAL APPLICABILITY

The teachings of the present disclosure are contemplated to be applicable to adjusting a sports implement system such as a golf club system to a wide variety of different configurations. While the following description focuses on system 10, it should be understood as generally applicable to any of the other embodiments contemplated herein. As discussed above, playing weight and playing length may be readily adjusted, as may a distribution of mass within a sports implement. In the context of a golf club system, adjustment of the distribution of mass is commonly understood to vary a "swing weight." By way of the present disclosure, players will be able to quickly and easily vary these and other factors, such as grip size or grip contour, during play or practice, tailoring a levering profile and other properties of a sports implement to suit their current preferences, or adapt to different playing conditions or problems. To this end, it is contemplated that a player might carry with them a complete set of the various different components which may be used to adjust a sports implement system in the field to any of the plethora of different possible configurations contemplated herein. The relative speed and ease of adjustments are also considered to enable a player ample opportunity to experiment with different configurations and observe the results on their own. With some general knowledge of the results to be expected from a sports implement system in different configurations, or simply out of curiosity or experimentation, a player might adjust the system one or more times during a round of play. One practical implementation strategy is nevertheless contemplated to be customizing a sports implement system with the input and supervision of colleagues, or a coach or other professional. Customizing a sports implement system according to the present disclosure thus might take place at a dealer or pro shop, or on a practice green at a golf course, for example.

Referring now to the drawings generally, but in particular to FIGS. 11-14, one method of customizing a sports implement system such as system 10 may include placing system 10 in a first configuration at which a first combination of length setting and weight components is installed within cavity 28. As mentioned above, FIG. 1 illustrates system 10 in one example first configuration, where weight components A and B are installed within cavity 28. From the first configuration, system 10 may be adjusted to a second configuration by way of swapping a second combination of the length setting and weight components for the first combination installed within cavity 28. One example includes swapping an assembly combination 40AG, for the first combination 40AB. The same length setting component 36 may be used with multiple different assembly combinations, though a spare length setting component (not shown) might also be provided.

In an embodiment where the assembly combinations are connectable to primary shaft 14, upon decoupling primary shaft 14 from grip shaft 20 via unlocking coupling component 60, primary shaft 14 may be slid out of cavity 28 with weight components A and B coupled therewith. Weight components A and B may then be decoupled from primary shaft 14, for example unscrewed, and then decoupled from one another to enable weight component G to be swapped with weight component B to render assembly combination 40AG. Assembly combination 40AG may then be coupled with primary shaft 14, and primary shaft 14 slid back into cavity 28 to a stop location at which length setting component 36 contacts blind cavity end 32. At the stop location, coupling component 60 may be re-locked. With assembly combination 40AG swapped for assembly combination 40AB within cavity 28, and coupling component 60 re-locked, system 10 may be set in the second configuration, including a combination of playing weight and playing length which is different from a combination of playing weight and playing length of the first configuration. Sports implement system 10 may also be adjusted to a third configuration by way of removing whichever of the first or second assembly combination, in the present example combination 40AB or 40AG, is installed within cavity 28, changing the length setting state of length setting component 36, and re-installing the adjusted combination within cavity 28.

For each adjustment in configuration of system 10, an installed combination of length setting and weight components may be removed from cavity 28, and its constituent weight components changed if desired, and/or the length setting state of length setting component 36 changed if desired, and the new, weight adjusted assembly combination and/or length adjusted assembly combination re-installed in cavity 28. Each time such a change is made, an adjusted playing length and/or adjusted playing weight based on weight and length of the installed assembly combination, as well as an adjustment to a levering profile of system 10 may result. It may also be appreciated that both playing weight and playing length may be adjusted at once by removing an installed assembly combination, swapping it for a different assembly combination, adjusting a length setting state of length setting component 36, and then re-installing the substitute assembly combination in cavity 28.

It will also be recalled that grip and shaft assembly 127 may be swapped for grip and shaft assembly 27. Accordingly, a player or assisting professional can create a great many different playing configurations for system 10, allowing the player to evaluate the levering action, feel, and perhaps most importantly successful performance, of system 10 in each of the many different configurations. A player may use system 10 in each of the different configurations, provide feedback to an assisting professional or simply make their own observations, and thus arrive at a customized playing length and playing weight, either for general use or to suit a specific set of conditions.

Thus, a customizing process with system 10 may include making a series of weight and/or length adjustments, and potentially grip adjustments, until player feedback indicates the player is satisfied. Customizing of system 10 may also include making a series of weight and/or length adjustments, and potentially grip adjustments, using system 10 in the resulting different configurations, and then returning to an earlier configuration after player feedback indicates he or she preferred an earlier permutation. In the context of golf, players may use system 10 to strike a golf ball via transferring a force from grip shaft 20 to primary shaft 14, to head 17, and to the golf ball, in a conventional manner during the customizing process. As mentioned above, over time players may develop knowledge of different putter, or other club type, configurations which best suit them for different playing conditions or problems such as wet greens versus dry greens, and thus make adjustments as described herein during a round of play.

Figure 13:
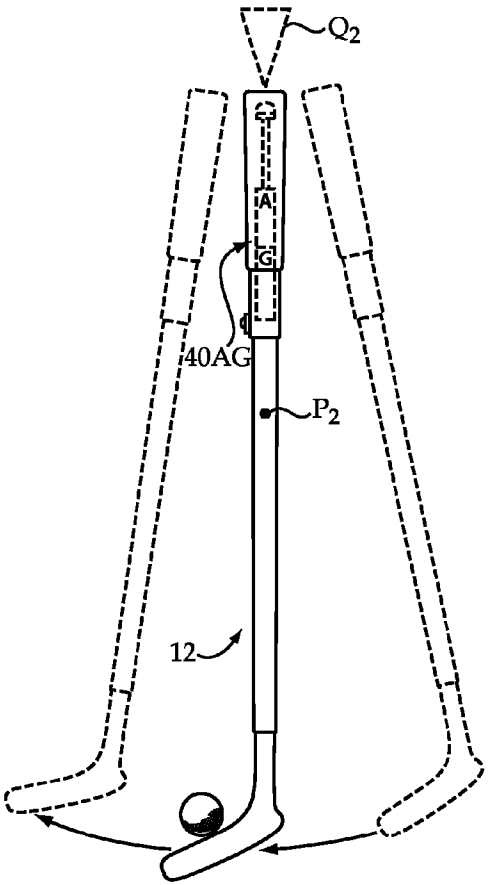
FIG. 13 is a diagrammatic view of a sports implement in a second customized configuration.
Figure 12:
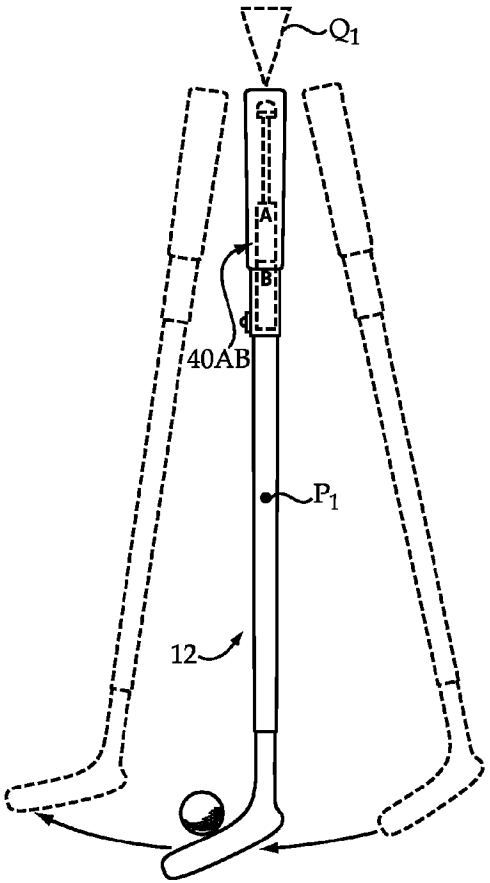
FIG. 12 is a diagrammatic view of a sports implement in a first customized configuration.

It will also be recalled that FIG. 1 illustrates system 10 in the example first configuration, having a first combination of playing weight and playing length. It will further be recalled that playing length may be adjusted, placing system 10 in a different configuration, referred to above as the third configuration, by removing assembly combination 40AB, adjusting length setting component 36, and re-installing the length adjusted assembly combination 40AB within cavity 28. FIG. 12 illustrates system 10 in this example length adjusted configuration, with back swing and follow-through positions shown in phantom, for an example putting stroke. It will further be recalled that both playing weight and playing length may be adjusted, either by way of a single adjustment step, or by separately adjusting playing weight and playing length. FIG. 13 illustrates system 10 in an example weight adjusted configuration, such as the second configuration described above, whereas FIG. 14 illustrates system 10 in a configuration at which both playing weight and playing length have been adjusted relative to the configurations of FIGS. 12 and 13.

Figure 14:
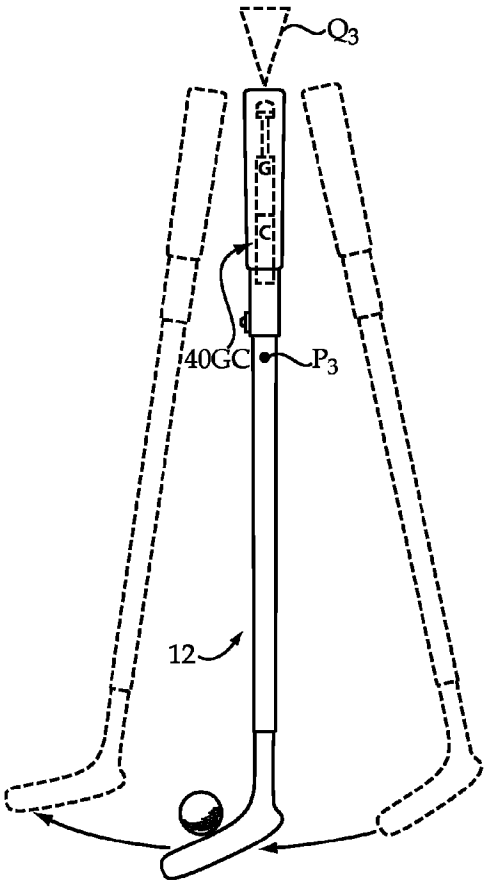
FIG. 14 is a diagrammatic view of a sports implement in a third customized configuration.

Those skilled in the art will appreciate the various different properties of a sports implement such as a golf club putter which may be varied by adjusting playing weight and playing length, axial distribution of mass, and grip size, grip contour, etc., in view of the teachings of the present disclosure. In the example configurations shown in FIGS. 1, 12, 13, and 14, these various different properties may all affect a levering profile of system 10. The levering profile may be understood as the set of properties which influence performance of sports implement 10 as a simple lever. Behavior of a user will of course also influence performance of sports implement system 10 as a lever, however, for purposes of explanation certain generalities may be drawn. For instance, each time a sports implement such as a golf club putter is used to transfer a force to a ball, it will typically be understood to perform as a lever rotated about a fulcrum. The fulcrum of rotation will typically be a point floating in space which is located at or spaced in a distal direction from the grip end of the sports implement. In FIGS. 12, 13, and 14, fulcrums of rotation $Q_1$, $Q_2$, and $Q_3$ are shown. Different combinations of playing weight and playing length may be associated with different locations of fulcrums of rotations $Q_1$, $Q_2$, and $Q_3$.

In many instances, it may be difficult to locate an actual position of these fulcrums of rotation precisely. This is due at least in part to the fact that a player may move their body differently when using different length and different weight sports implements. One can imagine extreme examples of an extraordinarily heavy golf putter, apt to be swung like a pendulum hanging from the player's shoulders. In such an example, which might not ever occur in the real world, the lever fulcrum might be spaced relatively far from a grip end of the golf putter. The user might have a tendency to impart relatively little motion to the putter by way of bending their wrists due to the very heavy weight. In contrast, an extraordinarily light putter might be swung almost purely with wrist action, less like a pendulum, and thus have a fulcrum of rotation relatively closer to a grip end of the club. As mentioned above, because movement patterns of a player's body can vary so widely, precise locations of lever fulcrums may not be readily determinable. It is expected, however, that in at least many instances, varying playing weight and playing length will tend to change a location of the fulcrum of rotation of a golf club such as a putter and, hence, location of the fulcrum of rotation is one property of a levering profile which may vary by adjusting system 10 to different configurations as described herein.

Another factor which may vary among the different configurations is a location of a balance point of sports implement 12, or swing weight, which is varied by changing a location of a center of mass. In FIGS. 12-14, points $P_1$, $P_2$, and $P_3$ represent example different locations of a center of mass. Since changing playing length also can affect a location of a center of mass, this factor may not be precisely known unless and until a user decides what insertion depth at which to place component 36 within the corresponding weight component 40. Still another property of the levering profile may include a total weight of implement 12. As described herein, a wide variety of different total weights are available by selecting which of weight components 40 to install within cavity 28.

As alluded to above, each of the adjusting steps and different configurations may be used by a player or professional to tailor and thereby customize a sports implement system to a particular player's preferences, or even to shape behavior toward some predefined goal such as correcting bad habits. In this general manner, each of the adjusting steps may follow use of system 10 in a different configuration. This strategy can take place by way of the relatively simple and rapid adjustment steps described herein, and is contemplated to provide a number of advantages over traditional designs. Rather than using a relatively large number of equal weight masses or the like, system 10 may utilize only two, or only two installed weight components plus several additional un-installed weight components. Similarly, playing length can be readily adjusted by changing the insertion depth of length setting component 36, without the need for adding or subtracting multiple spacing components, or using other unwieldy strategies.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages of the present disclosure will be apparent upon an examination of the attached drawings and appended claims.

What is claimed is:

1. A method of customizing a sports implement system having an elongate primary shaft and an elongate grip shaft and a customizing mechanism having a length setting component including a plurality of different length setting states, a plurality of weight components, and a coupling component for locking the grip shaft coaxially to the primary shaft, the method comprising the steps of:

providing a customizing mechanism comprising a plurality of selectively connectable weight components and a length setting component selectively and adjustably connectable to at least one of the weight components, the customizing mechanism further comprising a coupling component for locking the grip shaft coaxially to the primary shaft;

placing the sports implement system in a first configuration by: selecting a number of the weight components, with the length setting component connected to one of the weight components to form a first combination of length setting and weight components; adjusting the length setting component; installing the at which a first combination of the length setting and weight components is installed within a cavity provided in defined by at least one of the primary shaft and the grip shaft; joining the grip shaft to the primary shaft, with the primary shaft abutting the first combination; and locking the coupling component;

adjusting the sports implement system to a second configuration via swapping a second combination of the length setting and weight components for the first combination installed within the cavity; and adjusting the sports implement system to a third configuration via removing whichever of the first or second combination is installed within the cavity, adjusting changing the length setting state of the length setting component, and re-installing the corresponding combination within the cavity;

wherein each of the adjusting steps further includes a step of setting a combination of playing weight and playing length of the sports implement system at least in part by contacting the grip shaft and the primary shaft with the installed combination within the cavity, and locking the coupling component;

wherein each of the first, second, and third configurations includes a different combination of playing weight and playing length, and wherein the method further comprises a step of customizing the playing weight and playing length via the adjusting steps, responsive to using the sports implement system in each of the first, second, and third configurations.

2. The method of claim 1 wherein the step of adjusting the sports implement system to the second configuration includes swapping a number of weight components of the second combination having a first total weight for an equal number of weight components of the first combination having a second, different total weight.

3. The method of claim 2 wherein the step of adjusting the sports implement system to a second configuration further includes connecting the length setting component with one of a total of two weight components of the second combination, prior to swapping the second combination for the first combination.

4. The method of claim 3 wherein each of the adjusting steps further includes sliding the corresponding combination into the cavity, and then sliding the primary shaft into the cavity to a stop location defined by a length of the corresponding combination.

5. The method of claim 4 wherein the step of adjusting the sports implement system to a third configuration further includes changing an insertion depth of the length setting component within a bore formed in the corresponding one of the plurality of weight components.

6. The method of claim 2 wherein swapping the second combination for the first combination includes swapping a total of two weight components of the second combination for a total of two weight components of the first combination, and wherein each of the weight components of the first and second combinations include an identical geometric footprint.

7. The method of claim 1 wherein the step of setting the combination of playing weight and playing length further includes sliding the primary shaft relative to the grip shaft to a stop location at which the installed combination of length setting and weight components contacts each of the grip shaft and the primary shaft, and locking the coupling component at the stop location.

8. The method of claim 7 further comprising a step of aligning a first channel formed in the grip shaft with a second channel formed in the primary shaft, during sliding the primary shaft relative to the grip shaft.

9. The method of claim 8 wherein the step of setting the combination of playing weight and playing length further includes sliding the primary shaft into the grip shaft, and wherein aligning the first and second channels further includes aligning an open ended channel formed in the grip shaft with a closed ended channel formed in the primary shaft, and receiving a fastening assembly which is captive within the closed ended channel within the open ended channel.

10. The method of claim 9 wherein locking the coupling component further includes rotating a threaded fastener of the fastening assembly at the stop location.

11. The method of claim 1 wherein:

the method further includes the steps of using the sports implement system in each of the first, second, and third configurations, including transferring a force between the sports implement system and a ball according to a different levering profile in each of the first, second, and third configurations;

the levering profile being defined in part by the playing weight and playing length, and also in part by a different axial distribution of mass in each of the first, second, and third configurations; and the step of customizing further includes customizing the playing length and playing weight, responsive to player feedback which is based on transferring force in each of the first, second, and third configurations.

12. A sports implement system comprising:

a sports implement including an elongate primary shaft having a proximal shaft end and a distal shaft end, and an elongate grip shaft having a proximal grip end and a distal grip end, at least one of the primary shaft and the grip shaft having a cavity formed therein defining a longitudinal cavity axis extending between an open cavity end and a blind cavity end; and a customizing mechanism including a coupling component having a locking state for connecting the primary shaft coaxially with the grip shaft, and a release state;

the customizing mechanism further including at least a plurality of selectively connectable weight components, a length setting component, selectively and adjustably connectable to at least one weight component, the customizing mechanism having a plurality of different assembly combinations at which the at least one length setting component is connected to one of the weight components, and each of the assembly combinations having an equal number of weight components, a different weight, and an adjustable length;

wherein the plurality of assembly combinations includes a first assembly combination installed within the cavity and contacting each of the grip shaft and the primary shaft, and wherein the coupling component is in the locking state setting the sports implement system in a first configuration which includes a first playing weight and a first playing length based on a weight and length of the first assembly combination; and wherein the plurality of assembly combinations includes a second assembly combination, and wherein the sports implement system is adjustable to a second configuration which includes a second playing weight and a second playing length based on a weight and length of the second assembly combination, at least in part by swapping the second assembly combination into the cavity in place of the first assembly combination.

13. The sports implement system of claim 12 wherein each of the first and second assembly combinations includes a total of two weight components, and wherein each of the plurality of weight components includes an identical geometric footprint.

14. The sports implement system of claim 13 wherein the at least one length setting component includes a shaft with a head, wherein each of the weight components includes a bore formed therein and a fixturing mechanism configured to fix the shaft at a plurality of different insertion depths within the bore.

15. The sports implement system of claim 14 wherein the cavity is formed in the grip shaft, and wherein the head contacts the blind cavity end and one of the weight components of the first assembly combination contacts the distal shaft end.

16. The sports implement system of claim 12 wherein the coupling component includes a skirt located on the distal grip end, and the skirt defining an axially extending open ended channel in communication with the cavity.

17. The sports implement system of claim 16 wherein the coupling component further includes a closed ended channel formed in the primary shaft and in communication with the open ended channel, and a fastening assembly having a threaded fastener axially slidable within the closed ended channel.

18. The sports implement system of claim 12 wherein:

the sports implement includes a golf club having a head coupled with the primary shaft, and a hand grip coupled with the grip shaft;

the grip shaft includes a grip shaft of a first grip and shaft assembly having a first hand grip geometry, and having the cavity formed therein;

the sports implement system further includes a second grip and shaft assembly defining a second cavity having a cavity shape identical to a shape of the cavity formed in the first grip and shaft assembly; and the sports implement system includes a third configuration at which one of the first and second assembly combinations is installed within the second cavity, and the second grip and shaft assembly is connected coaxially with the primary shaft via the coupling component.

19. A method of adjusting a customizable levering profile of a sports implement having an elongate primary shaft, an elongate grip shaft, and a customizing mechanism comprising a plurality of selectively connectable weight components, at least one length setting component selectively and adjustably connectable to at least one of the weight components, and a coupling component for locking the grip shaft coaxially to the primary shaft, where a number of the weight components with the at least one length setting component connected to one of the weight components and adjusted for length setting is installed as a first assembly combination in a cavity provided in one of the grip shaft and the primary shaft, the method comprising the steps of:

decoupling the primary shaft from the grip shaft at least in part by unlocking the coupling component, and sliding one of the primary shaft and the grip shaft out of a the cavity formed in the other of the primary shaft and the grip shaft;

setting a playing weight of the sports implement at an adjusted playing weight at least in part by swapping a first second assembly combination of length setting and weight components for a second the first assembly combination of length setting and weight components installed within the cavity, the first and second assembly combinations each including an equal number of weight components;

setting a playing length of the sports implement system at an adjusted playing length at least in part by adjusting a length setting state of the at least one a length setting component of in the first second assembly combination, prior to installing the first second assembly combination within the cavity; and placing the sports implement in a configuration having an adjusted levering profile defined by the adjusted playing length and the adjusted playing weight at least in part by sliding the one of the primary shaft and the grip shaft back into the cavity, stopping the one of the primary shaft and the grip shaft at a stop location contacting the first second assembly combination, and re-locking the coupling component.

20. The method of claim 19 wherein unlocking the coupling component includes rotating a threaded fastener of a fastening assembly in a first direction, and wherein re-locking the coupling component further includes sliding the fastening assembly from a first location to a second location within overlapping channels formed in each of the grip shaft and the primary shaft, and rotating the threaded fastener in a second direction.

* * * * *